US010017343B2

(12) United States Patent
Iwama

(10) Patent No.: US 10,017,343 B2
(45) Date of Patent: Jul. 10, 2018

(54) IMAGE FORMING APPARATUS

(71) Applicant: BROTHER KOGYO KABUSHIKI KAISHA, Nagoya-shi, Aichi-ken (JP)

(72) Inventor: Noritaka Iwama, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/454,010

(22) Filed: Mar. 9, 2017

(65) Prior Publication Data

US 2017/0261906 A1 Sep. 14, 2017

(30) Foreign Application Priority Data

Mar. 14, 2016 (JP) ..... 2016-049634

(51) Int. Cl.
*B65H 85/00* (2006.01)
*B65H 5/06* (2006.01)
*G03G 15/00* (2006.01)

(52) U.S. Cl.
CPC ..... *B65H 5/062* (2013.01); *G03G 15/6502* (2013.01); *G03G 15/6529* (2013.01); *B65H 85/00* (2013.01); *B65H 2402/441* (2013.01); *B65H 2404/142* (2013.01); *B65H 2404/152* (2013.01); *B65H 2404/1522* (2013.01); *B65H 2601/11* (2013.01); *G03G 2215/00544* (2013.01); *G03G 2215/00586* (2013.01); *G03G 2215/0141* (2013.01)

(58) Field of Classification Search
CPC ..... B65H 2402/441; B65H 2404/142; B65H 2404/144; B65H 2404/152; B65H 2404/1522; B65H 2601/11; B65H 85/00; G03G 2215/0054; G03G 2215/00544; G03G 2215/00586
See application file for complete search history.

(56) References Cited

U.S. PATENT DOCUMENTS 9,156,639 B1 * 10/2015 Inoue ..... B65H 5/062
9,483,005 B2 * 11/2016 Kobayashi ..... B65H 5/062

FOREIGN PATENT DOCUMENTS

JP 2003-255644 A 9/2003
JP 2004-277182 A 10/2004
JP 2012-101904 A 5/2012

* cited by examiner

*Primary Examiner* — Jeremy R Severson
(74) *Attorney, Agent, or Firm* — Merchant & Gould P.C.

(57) ABSTRACT

An image forming apparatus configured to form images on a first surface and a second surface of a sheet includes an apparatus body, an image forming unit, a feed tray, and a return unit configured to return the sheet having an image formed on the first surface of the sheet toward the image forming unit. The return unit includes a first guide, a second guide, and an adjuster. The first guide is detachably attached to the second guide and includes a first roller and a positioned portion. The second guide is positioned in the apparatus body and includes a second roller facing the first roller, and a positioning portion configured to contact the positioned portion of the first guide, thereby positioning the first guide relative to the second guide. The adjuster is configured to adjust an orientation of the second guide relative to the apparatus body.

10 Claims, 10 Drawing Sheets

IMAGE FORMING APPARATUS

CROSS-REFERENCE TO RELATED APPLICATION

This application claims priority from Japanese Patent Application No. 2016-049634 filed on Mar. 14, 2016, the content of which is incorporated herein by reference in its entirety.

FIELD OF DISCLOSURE

Aspects of the disclosure relate to an image forming apparatus configured to form images on both surfaces of a sheet.

BACKGROUND

A known image forming apparatus configured to form images on both surfaces of a sheet includes, for example, an image forming unit and a return unit. The return unit is configured to return a sheet having an image on a first surface toward the image forming unit for forming an image on a second surface of the sheet.

SUMMARY

Typically, the return unit includes a fixed surface or guide at an end aligned along a sheet conveying path. In the return unit, a sheet is moved to the fixed guide and conveyed with a lateral edge thereof aligned with the fixed guide for correct positioning and orientation. Such single edge alignment may be inappropriate for relatively smaller-sized sheets (e.g., A5-sized sheets), which are smaller than larger-sized sheets (e.g., A4-sized sheets), because the smaller-sized sheets need to be moved farther to the guide than the larger-sized sheets. Depending on the distance or length of the path in the return unit, the smaller-sized sheets may not reach the guide while being conveyed in the return unit. A longer length of the path in the return unit may allow the smaller-sized sheet to reach the guide, but may increase the physical size of the image forming apparatus.

One or more aspects of the discloser provide an image forming apparatus configured to form images on both first surface and second surface of a sheet, e.g., a relatively smaller-sized, A5-sized sheet.

According to one or more aspects of the disclosure, an image forming apparatus may configured to form images on a first surface and a second surface of a sheet includes an apparatus body, an image forming unit configured to form the images on the sheet, a feed tray detachably attached to the apparatus body, and a return unit configured to return the sheet having an image formed on the first surface of the sheet toward the image forming unit. The return unit includes a first guide, a second guide, and an adjuster. The first guide is detachably attached to the second guide. The first guide includes a first roller configured to rotate in contact with the sheet and a positioned portion. The second guide is positioned in the apparatus body. The second guide includes a second roller configured to rotate in contact with the sheet at a position facing the first roller, and a positioning portion configured to contact the positioned portion of the first guide, thereby positioning the first guide relative to the second guide. The adjuster is configured to adjust an orientation of the second guide relative to the apparatus body.

BRIEF DESCRIPTION OF THE DRAWINGS

Reference is made to the following description taken in connection with the accompanying drawings, like reference numerals being used for like corresponding parts in the various drawings.

DETAILED DESCRIPTION

Illustrative embodiments according to one or more aspects of the disclosure are merely examples, and various changes, arrangements and modifications may be made therein without departing from the spirit and scope of the disclosure.

One or more aspects of the disclosure are described in conjunction with a color image forming apparatus. Components of the image forming apparatus may be described using directional terminology such as "top," "bottom," "front," "rear," "left," "right" etc. Because the disclosed components can be positioned in a number of different orientations, the directional terminology is used for purposes of illustration and is in no way limiting.

It must be noted that, as used in the specification and the appended claims, the singular forms "a," "an" and "the" may include plural referents unless the context clearly dictates otherwise.

1. General Configuration of Image Forming Apparatus

Figure 1:
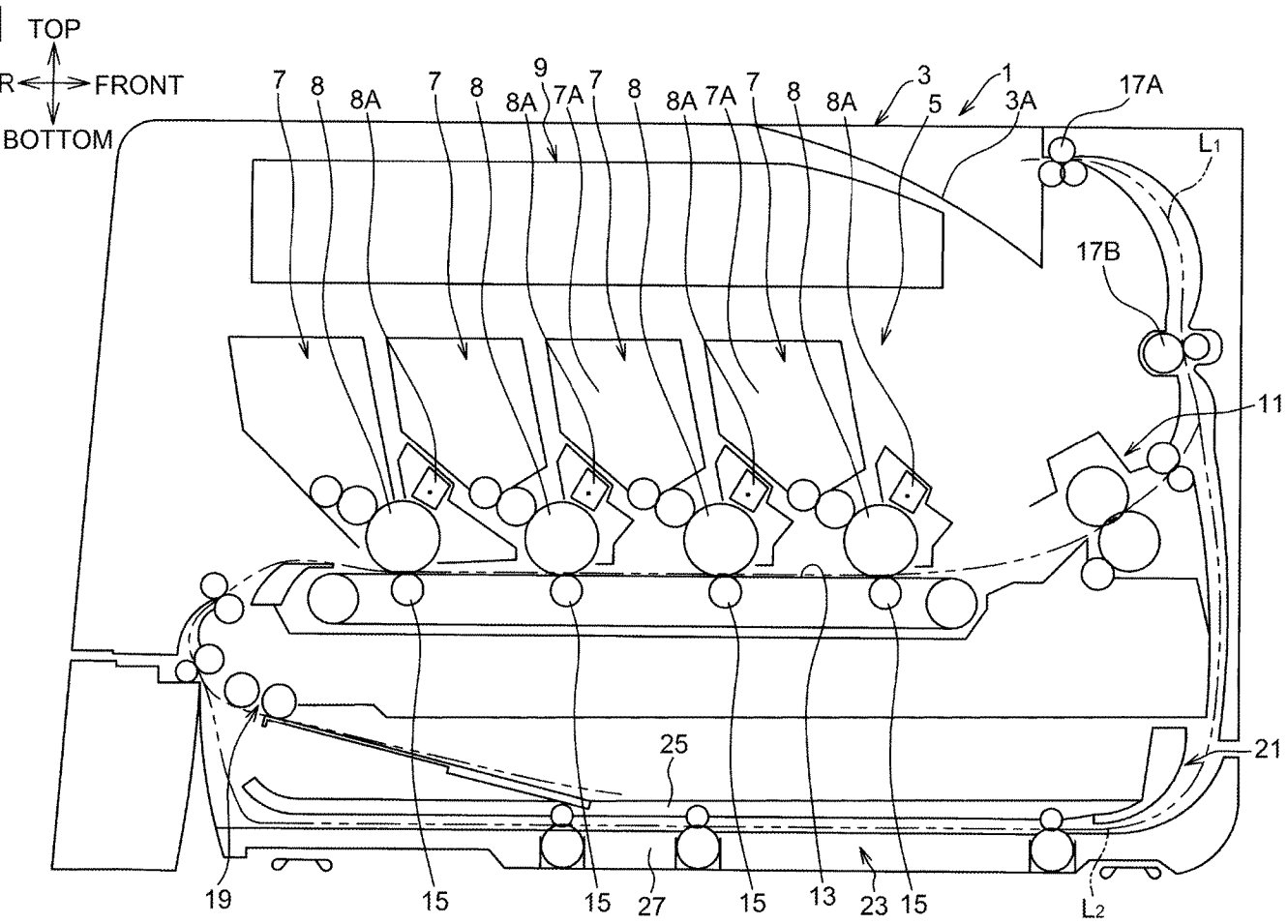
FIG. 1 is a sectional view of an image forming apparatus in an illustrative embodiment according to one or more aspects of the disclosure.

As depicted in FIG. 1, an image forming apparatus 1 includes a casing 3 and an image forming unit 5 that is disposed in the casing 3 and configured to form an image on a sheet, e.g., a paper sheet. The image forming unit 5 is of, for example, an electrophotographic type. The image forming unit 5 includes a plurality of developing cartridges 7, a plurality of photosensitive drums 8, a plurality of chargers 8A, a light exposer 9, and a fixing unit 11.

Each of the developing cartridges 7 is configured to contain a different one of colored developers (e.g., yellow, magenta, cyan, and black).

The photosensitive drums 8 and the chargers 8A are provided in correspondence with the developing cartridges 7. In short, the numbers of the photosensitive drums 8, the chargers 8A, and the developing cartridges 7 are all the same (e.g., four). Each of the chargers 8A is configured to charge a corresponding one of the photosensitive drums 8. The light exposer 9 is configured to expose the photosensitive drums 8 with light to form electrostatic latent images on the photosensitive drums 8.

The electrostatic latent images on the photosensitive drums 8 are developed into developer images by the developers supplied from the developing cartridges 7. The developer images corresponding to the electrostatic latent images are thus formed on outer surfaces of the photosensitive drums 8.

A belt 13, e.g., an endless belt, is disposed below the photosensitive drums 8. The belt 13 is configured to convey the sheet toward the fixing unit 11.

Transfer members 15 are disposed facing the photosensitive drums 8 with the belt 13 between the transfer members 15 and the photosensitive drums 8. The transfer members 15 are configured to transfer the developer images on the photosensitive drums 8 to the sheet. The developer images on the photosensitive drums 8 are transferred one on top of another to the sheet that is conveyed by the belt 13.

The fixing unit 11 is configured to apply heat and pressure to the developers transferred to the sheet, to thermally fix the developer images on the sheet. The sheet having an image thereon is discharged onto a discharge tray 3 by discharge rollers 17A and 17B.

A feed mechanism 19 configured to feed sheets in a feed tray 21, one at a time, toward the image forming unit 5, is disposed upstream of the belt 13 in a sheet conveying direction. A direction perpendicular to the sheet conveying direction and a thickness direction of a sheet may be hereinafter referred to as a "width direction." The width direction may correspond to the left-right direction of the image forming apparatus 1.

The feed tray 21 is disposed below the photosensitive drums 8. The feed tray 21 is configured to support one or more sheets to be fed to the image forming unit 5. The sheets may be accommodated in the feed tray 21 such that the centerline of a sheet, which is orthogonal to the width direction, corresponds to or aligns with the centerline of the feed tray 21, which is orthogonal to the width direction. The feed tray 21 is detachably attached to an apparatus body of the image forming apparatus 1. In other words, the feed tray 21 is configured to slidably move relative to the apparatus body in an arrangement direction of the photosensitive drums 8 (e.g., the front-rear direction).

The apparatus body is a portion of the image forming apparatus 1 that will not be disassembled by users. The apparatus body includes the casing 3 and a pair of main frames (not depicted). The main frames are plate-shaped structural members. Some components, such as the fixing unit 11, are attached or secured to the main frames. The main frames are spaced apart from each other in a horizontal direction, with the fixing unit 11 between the main frames.

2. Duplex Printing

The image forming apparatus 1 has a simplex printing mode and a duplex printing mode. The simplex printing mode allows printing of a sheet on a single side. The duplex printing mode allows printing of a sheet on both sides.

For printing on both sides of the sheet, the image forming apparatus 1 includes a return unit 23 configured to return or re-convey a sheet having an image on one side (e.g., a first side) thereof, toward the image forming unit 5. The return unit 23 is disposed below the feed tray 21 in the apparatus body. The return unit 23 will be described in more detail below.

In the duplex printing mode, after an image is formed on a first side of a sheet at the image forming unit 5 (e.g., the fixing unit 11), the sheet having the image on the first side is conveyed toward the discharge tray 3A located above the feed tray 21, as depicted in FIG. 1 by a chain line L1.

The sheet having the image on the first side is nipped by discharge rollers 17A and 17B. In response to the discharge rollers 17A and 17B nipping the sheet, the discharge rollers 17A and 17B are rotated reversely, and thus the sheet is conveyed downward through a path defined in a rear portion of the apparatus body, as depicted by a chain line L2 in FIG. 1. The sheet is re-conveyed through the return unit 23 to the image forming unit 5, at which a second or back side of the sheet faces the photosensitive drums 8 and receives an image from the photosensitive drums 8.

The sheet having the images on both sides is discharged onto the discharge tray 3A, without being conveyed to the return unit 23.

In the simplex printing mode, a sheet is fed from the feed mechanism 19 to the image forming unit 5 where an image is formed on one side of the sheet. The sheet is then discharged onto the discharge tray 3A, without being conveyed to the return unit 23.

3. Return Unit 3.1 General Configuration of Return Unit

Figure 2:
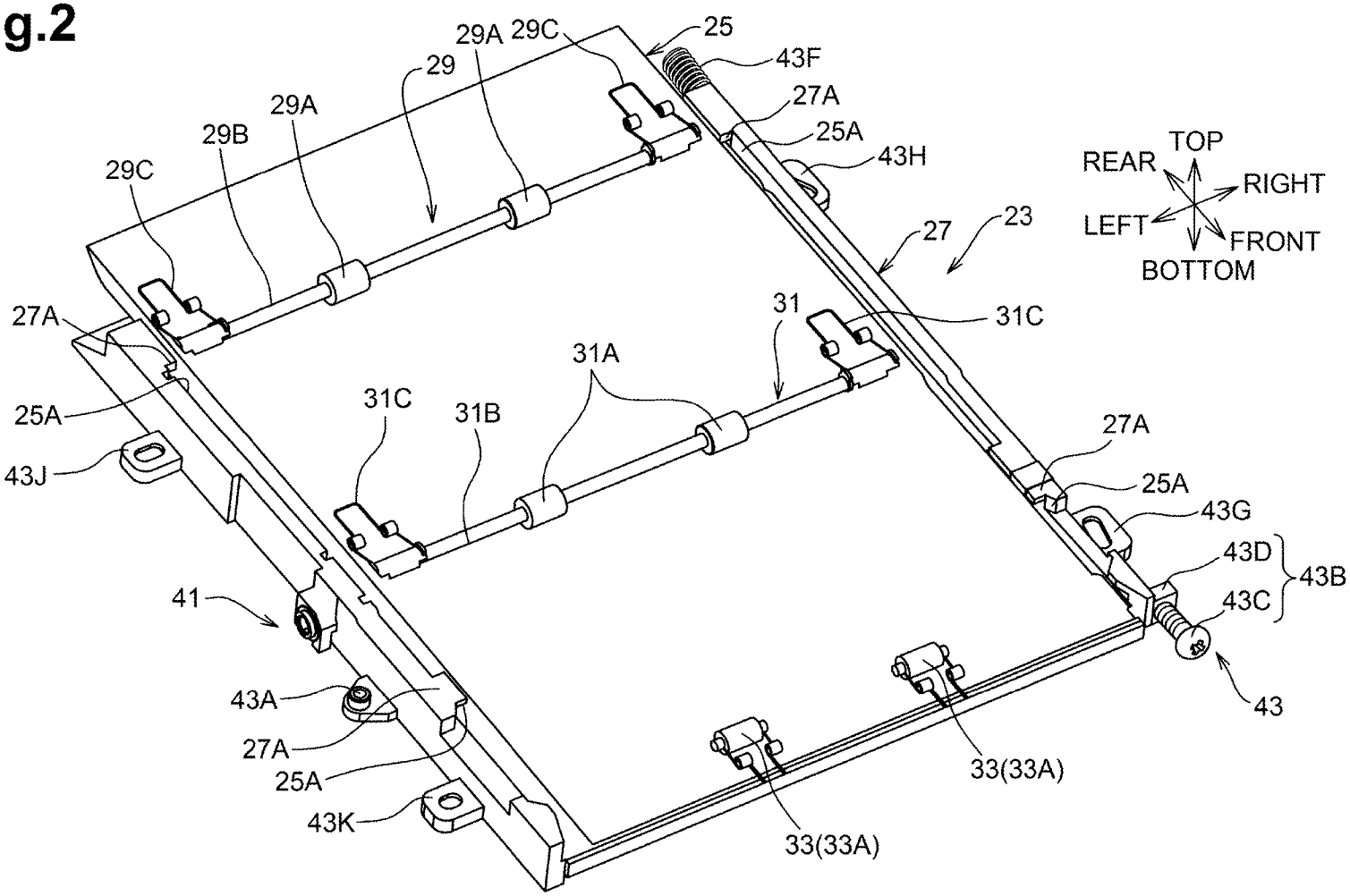
FIG. 2 is a perspective view of a return unit of the image forming apparatus in the illustrative embodiment according to one or more aspects of the disclosure.
Figure 3:
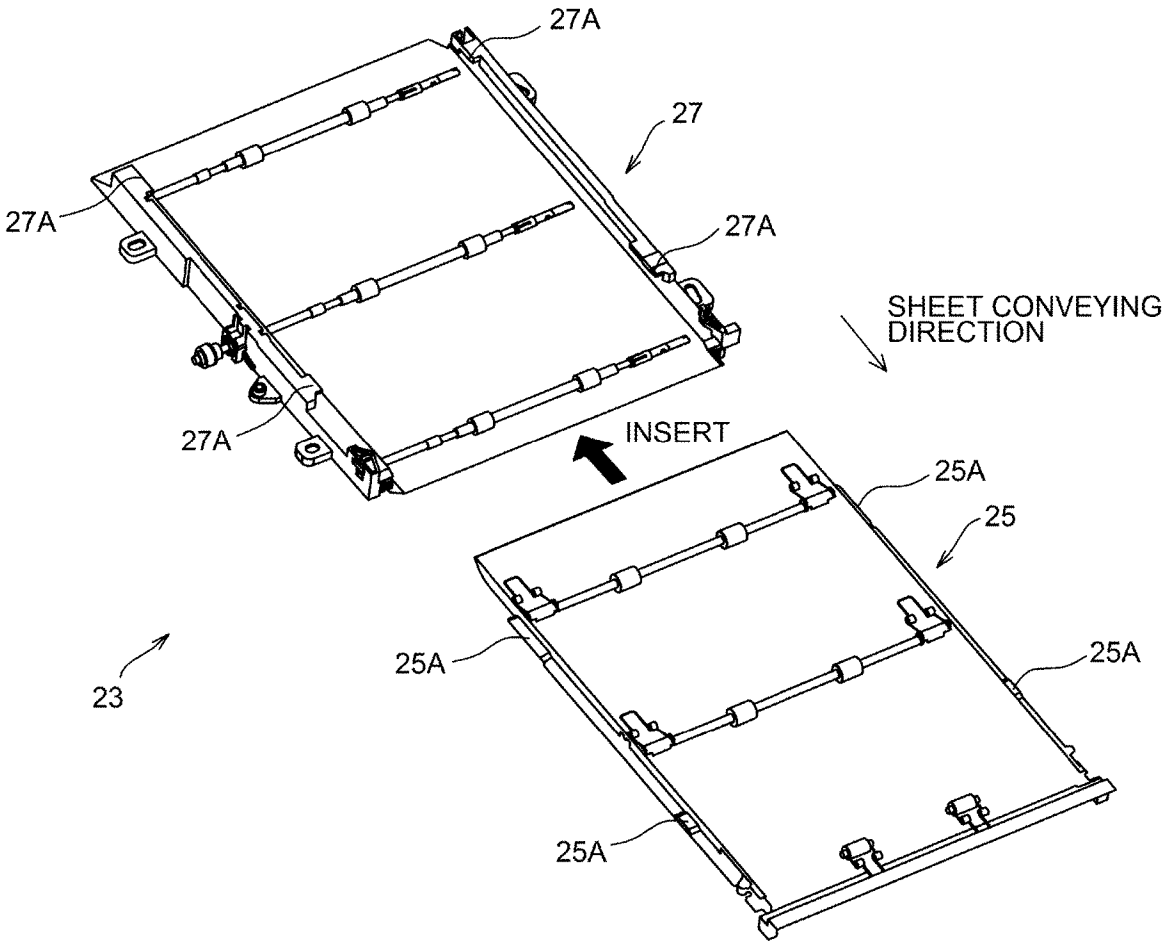
FIG. 3 is a perspective view of a first guide and second guide of the return unit in the illustrative embodiment according to one or more aspects of the disclosure.

As depicted in FIGS. 2 and 3, the return unit 23 includes a first guide 25, a second guide 27, and an adjuster 43.

The first guide 25 and the second guide 27 are configured to guide a sheet therebetween. The first guide 25 and the second guide 27 face each other in a thickness direction of a sheet to be conveyed in the return unit 23. The thickness direction of a sheet to be conveyed in the return unit 23 may be simply referred to as the "sheet thickness direction". In this embodiment, the first guide 25 is disposed above the second guide 27, and the second guide 27 is disposed below the first guide 25. The feed tray 21 is detachably attached to the apparatus body above the first guide 25, which is disposed above the second guide 27.

Each of the first guide 25 and the second guide 27 has a generally plate shape. The guides 25 and 27 guide the sheet in a generally horizontal direction.

The first guide 25 is detachably attached to the second guide 27. The first guide 25 is configured to slidably move along the sheet conveying direction, as depicted in FIG. 3, relative to the second guide 27. The first guide 25 may be mounted to the second guide 27 by slidably moving the first guide 25 in an inserting direction, relative to the second guide 27.

Figure 4:
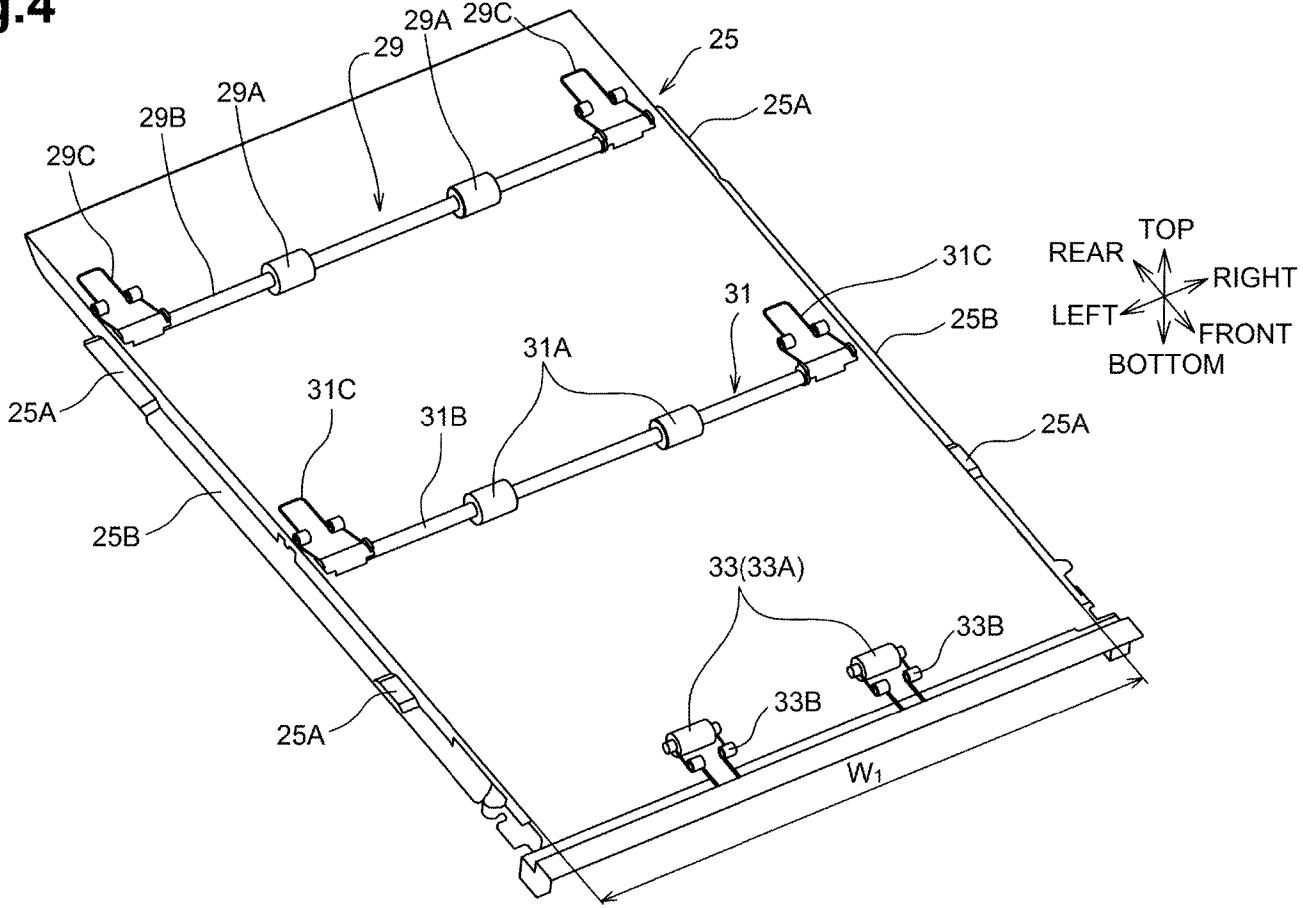
FIG. 4 is a perspective view of the first guide in the illustrative embodiment according to one or more aspects of the disclosure.
Figure 5:
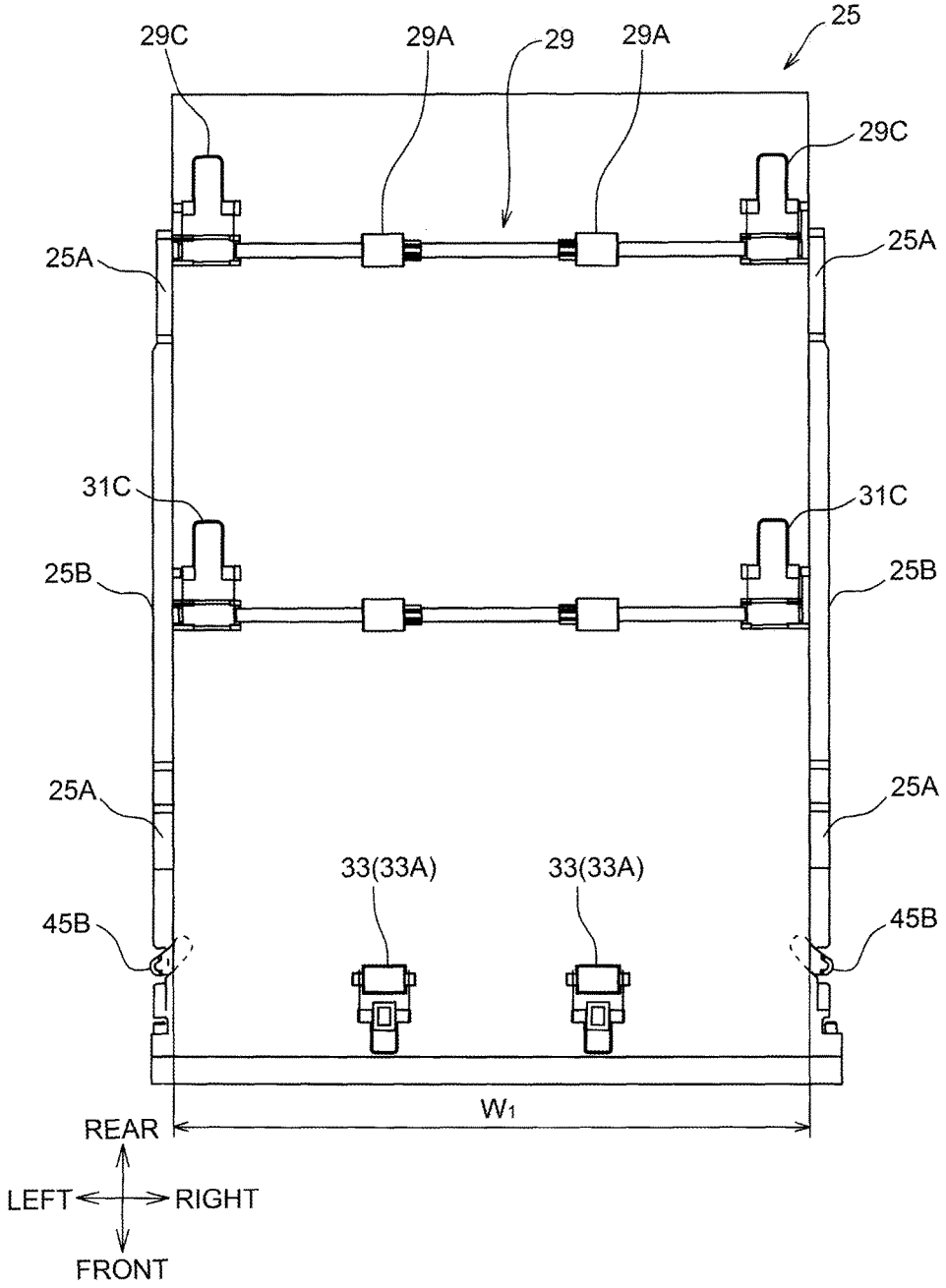
FIG. 5 is a top view of the first guide in the illustrative embodiment according to one or more aspects of the disclosure.

As depicted in FIGS. 4 and 5, the first guide 25 includes a plurality of, e.g., four, first positioned portions 25A, and a plurality of, e.g., two, slide portions 25B.

The first guide 25 has a sheet passing zone W1 where the sheet is to pass. The first positioned portions 25A are located, in the width direction, at opposite end portions (e.g., left and right end portions) of the first guide 25 and outside the sheet passing zone W1 of the first guide 25. The end portions of the first guide 25 corresponds to portions adjacent to left and right ends of the first guide 25. More specifically, each end portion of the first guide 25 has two first positioned portions 25A, which are spaced apart from each other in the sheet conveying direction.

The slide portions 25B are located outside the sheet passing zone W1 of the first guide 25 in the width direction, and constitute sidewalls each extending in the sheet conveying direction and protruding in the width direction relative to the sheet passing zone W1.

Figure 6:
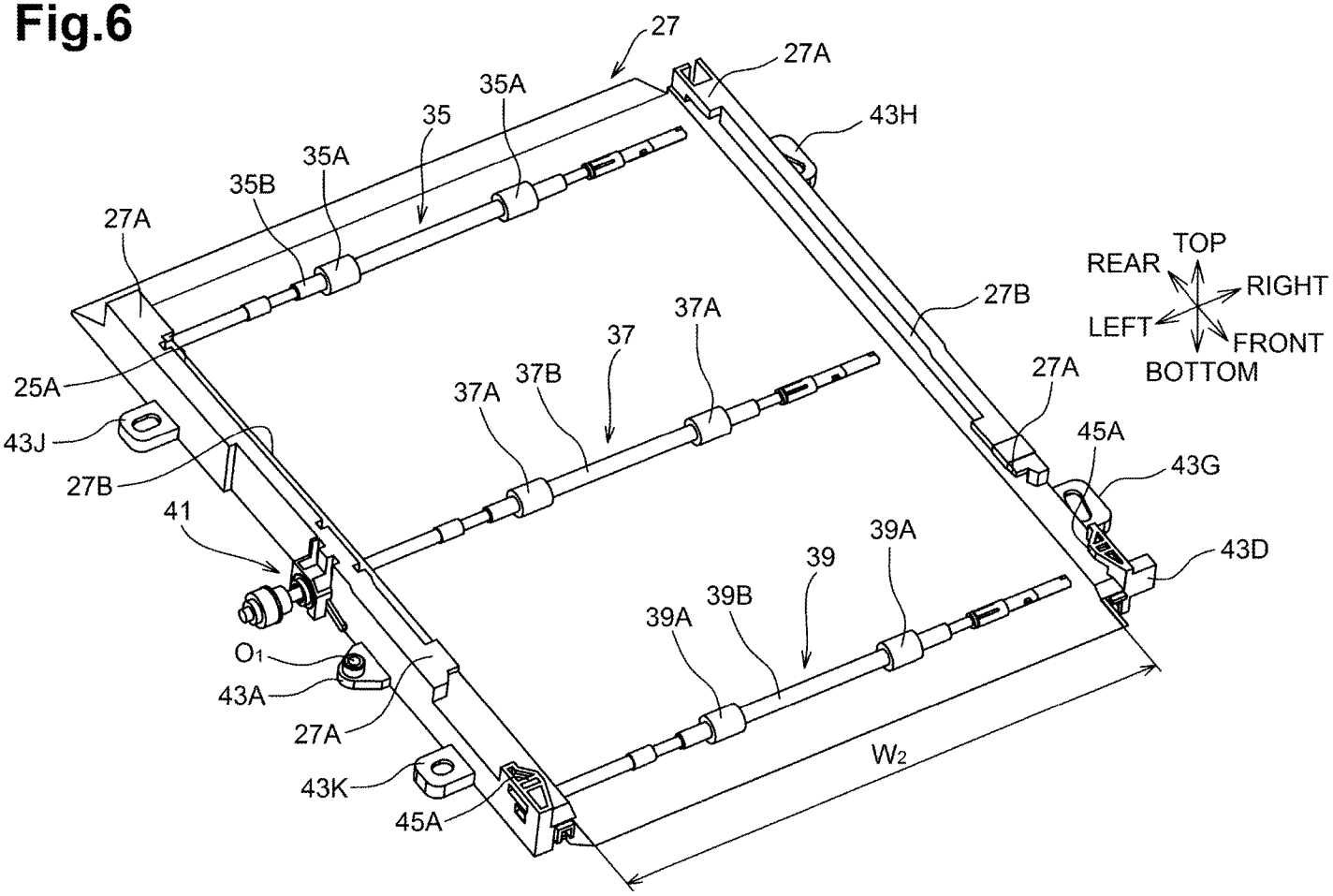
FIG. 6 a perspective view of the second guide in the illustrative embodiment according to one or more aspects of the disclosure.
Figure 7:
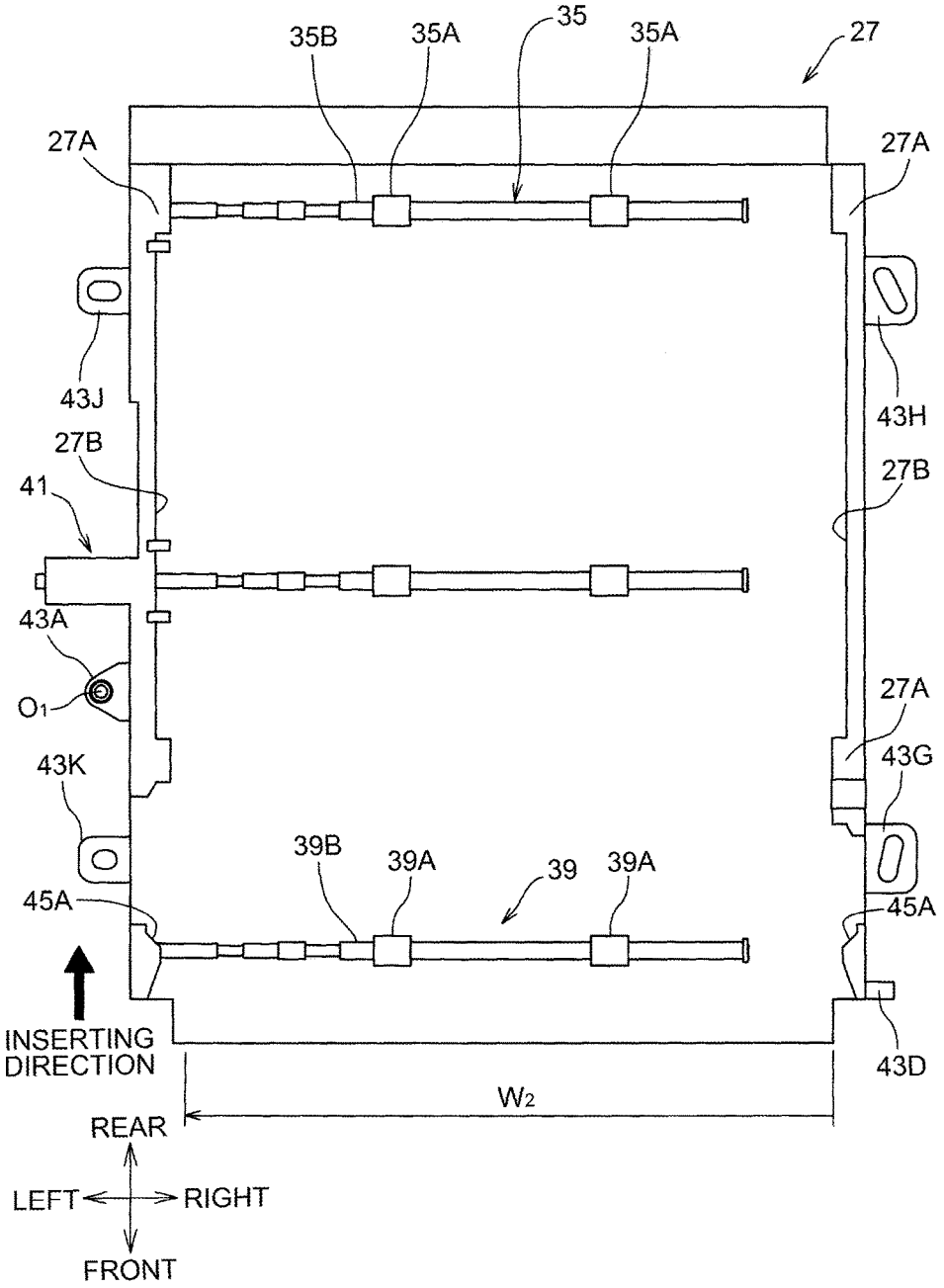
FIG. 7 is a top view of the second guide in the illustrative embodiment according to one or more aspects of the disclosure.

As depicted in FIGS. 6 and 7, the second guide 27 includes a plurality of, e.g., four, first positioning portions 27A, and a plurality of, e.g., two, slide guides 27B.

Figure 8A:
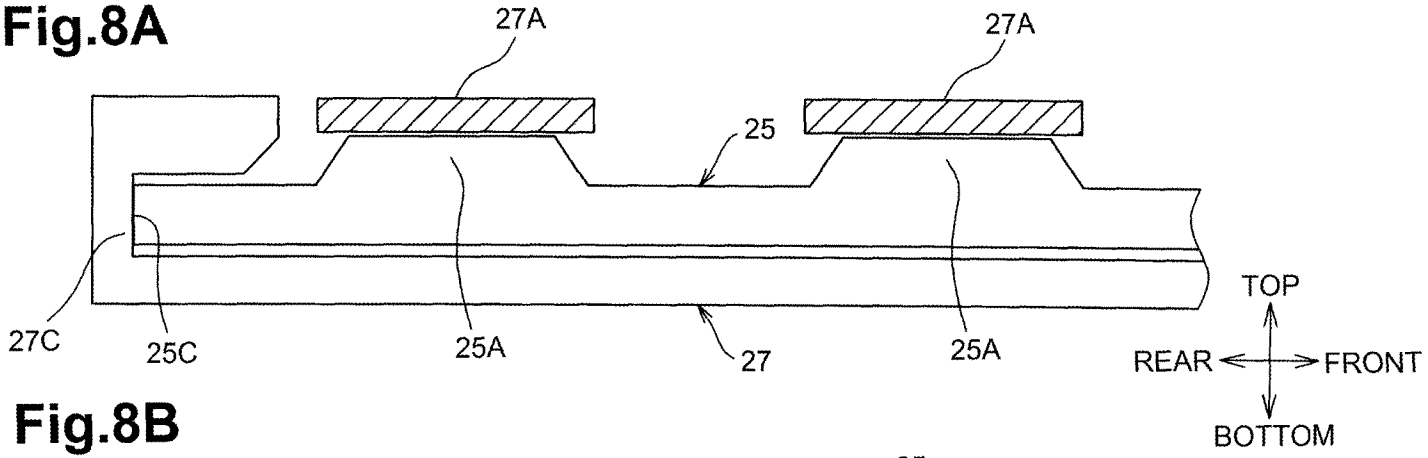
FIG. 8A is a schematic illustration of positioned portions of the first guide and positioning portions of the second guide in the illustrative embodiment according to one or more aspects of the disclosure, illustrating how the first guide is positioned relative to the second guide.

Each of the first positioning portions 27A is disposed at a portion of the second guide 27 corresponding to a respective one of the first positioned portions 25A of the first guide 25. The first positioning portions 27A are configured to guide the first guide 25 by contacting the first positioned portions 25A (refer to FIG. 4) of the first guide 25. As depicted in FIG. 8A, the first positioning portions 27A contact upper surfaces of the first positioned portions 25A. Thus, these contacts between the first positioning portions 27A and the first positioned portions 25A position the first guide 25 relative to the second guide 27 in the vertical direction.

As depicted in FIGS. 6 and 7, the second guide 27 has a sheet passing zone W2 where the sheet is to pass. The slide guides 27B are located, in the width direction, at opposite end portions (e.g., left and right end portions) of the second guide 27 and outside the sheet passing zone W2 of the second guide 27. The end portions of the second guide 27 corresponds to portions adjacent to left and right ends of the second guide 27. The slide guides 27B constitute wall surfaces extending in the sheet conveying direction.

The slide guides 27B are configured to guide the movement of the first guide 25 by slidably contacting the slide portions 25B.

Figure 8B:
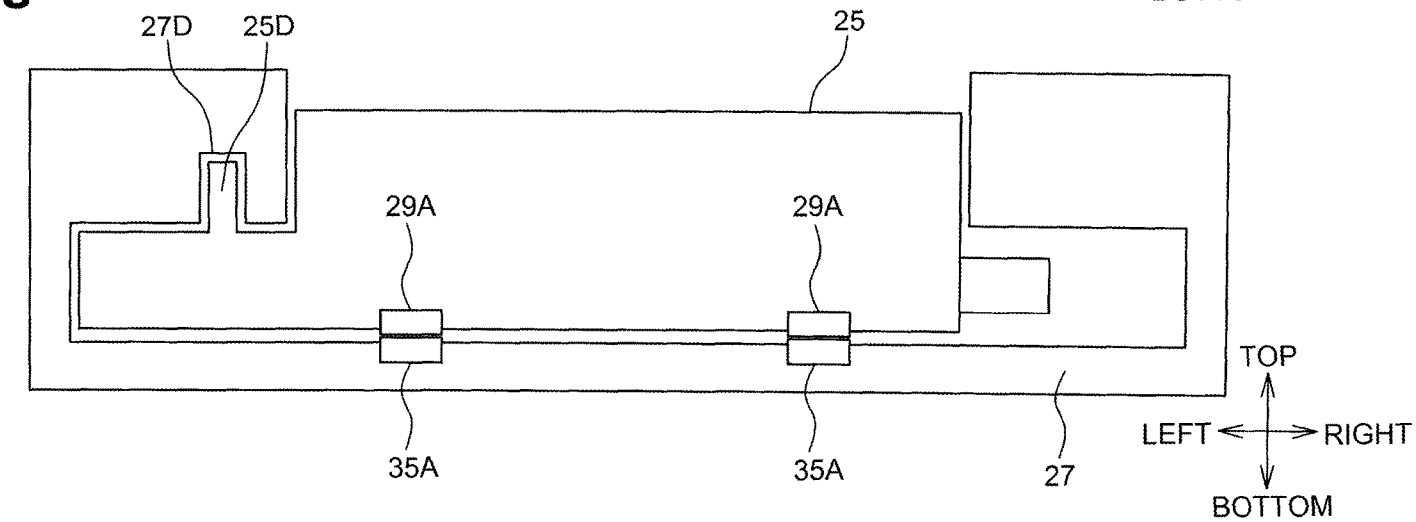
FIG. 8B is a schematic illustration of a third positioned portion of the first guide and a third positioning portion of the second guide in the illustrative embodiment according to one or more aspects of the disclosure, illustrating how the first guide is positioned relative to the second guide.

As depicted in FIGS. 8A and 8B, the first guide 25 further includes a second positioned portion 25C and a third positioned portion 25D. The second guide 27 further includes a second positioning portion 27C and a third positioning portion 27D.

The first guide 25 is slidingly inserted into the second guide 27 in a direction from a front end to a rear end of the second guide 27. Thus, the second positioned portion 25C is located at a rear end of the first guide 25, and the second positioning portion 27C is also located at the rear end of the second guide 27. The first guide 25 is inserted into the second guide 27 until the second positioning portion 25C contacts the second positioning portion 27C. Thus, the first guide 25 is positioned relative to the second guide 27 with respect to the front-rear direction, e.g., the sheet conveying direction.

As depicted in FIG. 8B, the third positioned portion 25D is located at an end portion (e.g., a left end portion) of the first guide 25 in the width direction. The third positioned portion 25D protrudes in the vertical direction (e.g., upward) from the first end portion of the first guide 25.

The third positioning portion 27D is located at a first end portion (e.g., a left end portion) of the second guide 27 in the width direction. The first end portion of the second guide 27 corresponds to the first end portion of the first guide 25 in the width direction. The third positioning portion 27D has a recessed shape with an open end facing downward. The third positioning portion 27D includes sidewalls spaced from each other in the width direction to sandwich and contact the third positioned portion 25D. The protruding third positioned portion 25D enters the recessed third positioning portion 27D, thereby positioning the first guide 25 relative to the second guide 27 with respect to the width direction (e.g., the left-right direction).

The third positioned portion 25D, the third positioning portion 27D, and the reference portion 43A (described in detail below) are disposed at a first end portion (e.g., a left end portion) of the return unit 23 in the width direction. The first end portion of the return unit 23 corresponds to the first end portion of each of the first guide 25 and the second guide 27 in the width direction.

Figure 10:
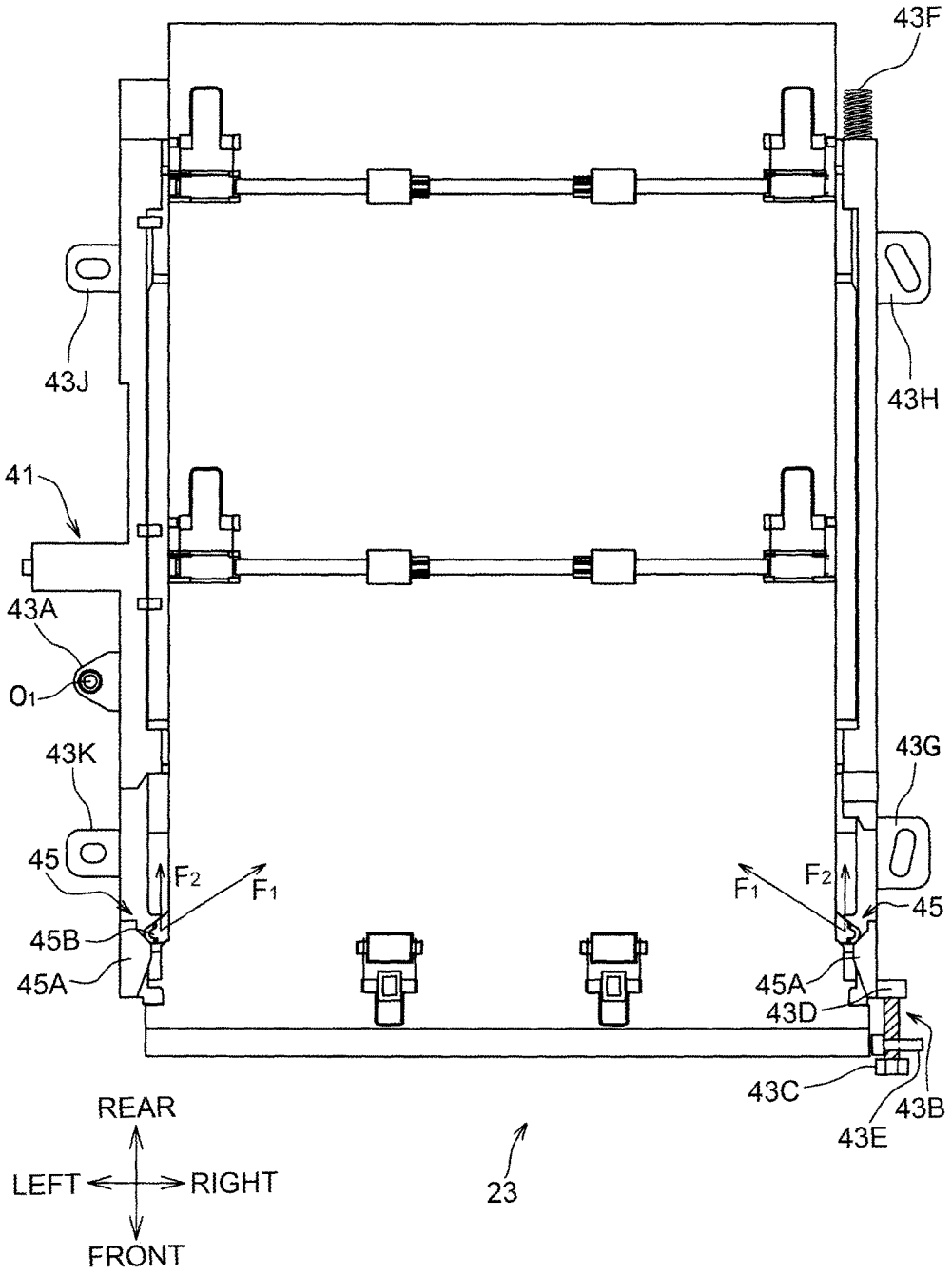
FIG. 10 is a top view of the return unit in the illustrative embodiment according to one or more aspects of the disclosure.

As depicted in FIG. 10, the return unit 23 includes engaging portions 45 located adjacent to opposite ends of the return unit 23 in the width direction. Specifically, the engaging portions 45 are located at front-left and front-right portions of the return unit 23. The engaging portions 45 are configured to secure the first guide 25 relative to the second guides 27.

Each engaging portion 45 includes a cam surface 45A (in FIG. 7), and a movable portion 45B (in FIG. 5). The cam surface 45A is provided at each end portion of the second guide 27 in the width direction, and the movable portion 45B is provided at each end portion of the first guide 25 in the width direction.

The cam surface 45A is angled relative to the inserting direction of the first guide 25 (e.g., the front-rear direction) and generally parallel to the sheet thickness direction. A line normal to the cam surface 45A faces toward a downstream side in the inserting direction.

The movable portion 45B is configured to slidably move on or relative to the cam surface 45 such that the movable portion 45B engages with and disengages from the cam surface 45. The movable portion 45B is coupled to a spring (not depicted), which biases the movable portion 45B against the cam surface 45A or applies an action force to the cam surface 45A to increase contact pressure between the cam surface 45A and the movable portion 45B.

Thus, the movable portion 45B receives from the cam surface 45A a reaction force F1 when the movable portion 45B is in contact with the cam surface 45A as depicted in FIG. 10.

The reaction force F1 includes a component force F2 directed toward the downstream side in the inserting direction, since a portion of the cam surface 45A contacting the movable portion 45B faces toward the downstream side in the inserting direction, as depicted in FIG. 10.

The component force F2 helps increase the contact pressure between the second positioned portion 25C and the second positioning portion 27C, reducing undesired movement of the first guide 25 in the front-rear direction. The reaction force F1 helps increase the contact pressure between the third positioned portion 25D and the third positioning portion 27D, reducing undesired movement of the first guide 25 in the width direction.

3.2 Rollers of Return Unit

As depicted in FIG. 4, the first guide 25 includes a first roller 29, a third roller 31, and a fifth roller 33 that are provided for returning a sheet toward the image forming unit 5. Those rollers 29, 31, and 33 are spaced from one another in the sheet conveying direction. The first roller 29, the third roller 31, and the fifth roller 33 are arranged in this order from an upstream side in the sheet conveying direction.

The first roller 29 is a follower roller configured to rotate in contact with the advancing sheet. The first roller 29 includes a plurality of roller portions 29A, a shaft 29B, and at least one spring 29C (e.g., two springs 29C). The roller portions 29A are configured to rotate in contact with the sheet. The shaft 29B supports the roller portions 29A. The shaft 29B is mounted or attached to the first guide 25 such that the shaft 29 is movable in a direction crossing a surface of the advancing sheet (e.g., the sheet thickness direction).

In the illustrative embodiment, the springs 29C are mounted on both ends of the shaft 29B in an axial direction thereof. The springs 29C exert elastic force for pressing the roller portions 29A via the shaft 29B against a sheet to be guided in the return unit 23.

The third roller 31 includes a plurality of roller portions 31A, a shaft 31B, and springs 31C. The third roller 31 has a similar structure to the first roller 29, and thus the details are not repeated here for purposes of brevity.

The fifth roller 33 includes a plurality of roller portions 33A and springs 33B. The roller portions 33A are follower rollers configured to rotate in contact with the advancing sheet. The roller portions 33A are mounted to the first guide 25 separately and independently. The springs 33B exert elastic force for pressing the roller portions 33A against the sheet.

As depicted in FIG. 6, the second guide 27 includes a second roller 35, a fourth roller 37 and a sixth roller 39 that are provided for returning the sheet toward the image forming unit 5. Those rollers 35, 37 and 39 are spaced from one another in the sheet conveying direction. The second roller 35, the fourth roller 37, and the sixth roller 39 are arranged in this order from the upstream side in the sheet conveying direction.

The second roller 35 includes a plurality of roller portions 35A, and a shaft 35B. The roller portions 35A are configured to rotate in contact with a sheet to apply a conveyance force to the sheet. The shaft 35 is configured to receive drive force from the apparatus body, via a coupling portion 41 to rotate the roller portions 35A.

The shaft 35B is mounted or attached to the second guide 27 such that the shaft 35 is rotatable while the relative position between the shaft 35B and the second guide 27 is fixed. The shaft 35B receives the drive force from the coupling portion 41 via a transmission device (not depicted) such as a drive shaft or a toothed belt.

The fourth roller 37 includes a plurality of roller portions 37A and a shaft 37B. The sixth roller 39 also includes a plurality of roller portions 39A and a shaft 39B. The fourth roller 37 and the sixth roller 39 each have a similar structure to the second roller 35, and thus the details are not repeated here for purposes of brevity.

Figure 9A:
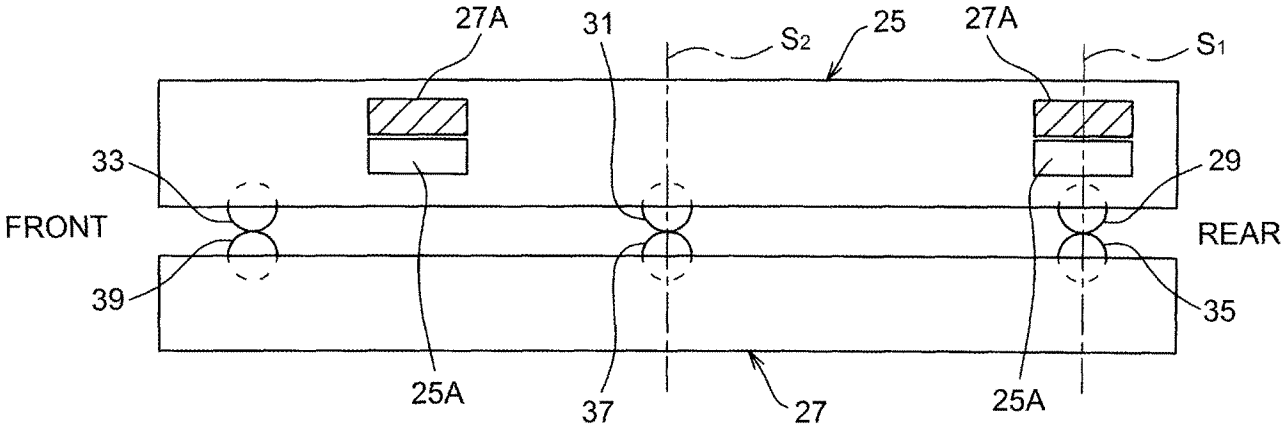
FIGS. 9A and 9B illustrate arrangements of rollers of the first guide and the second guide in the illustrative embodiment according to one or more aspects of the disclosure.

With the first guide 25 mounted to the second guide 27 as depicted in FIG. 9A, the axes of the rollers 29, 31, 33, 35, 37, and 39 are generally parallel to each other. The axes of the rollers 29, 31, 33, 35, 37, and 39 extend in the width direction.

More specifically, the axis of the first roller 29 is generally parallel to the axis of the second roller 35. Similarly, the axis of the third roller 31 is generally parallel to the axis of the fourth roller 37. The axis of the fifth roller 33 is generally parallel to the axis of the sixth roller 39.

An imaginary plane S1 is defined that includes axes of the first roller 29 and the second roller 35. The imaginary plane S1 passes through a contact portion between the rear-side first positioning portion 25A and the rear-side first positioning portion 27A located at each end portion of the return unit 23.

The contact portion between the rear-side first positioning portion 25A and the rear-side first positioning portion 27A receives the elastic force of the springs 29C acting on the shaft 29B to press the first roller 29 directly to the second roller 35.

Another imaginary plane S2 is defined that includes axes of the third roller 31 and the fourth roller 37. The imaginary plane S2 is spaced in the sheet conveying direction or away from a contact portion between the front-side first positioning portion 25A and the front-side first positioning portion 27A located at each end portion of the return unit 23. The contact portion between the front-side first positioning portion 25A and the front-side first positioning portion 27A receives the elastic force of the springs 31C and 33B.

3.3 Adjuster

The adjuster 43 is configured to adjust an angular axial orientation of the second roller 35 of the second guide 27 relative to the apparatus body. More specifically, the adjuster 43 is configured to adjust the orientation of the second guide 27 relative to the apparatus body, thereby adjusting the angular axial orientation of the second roller 35 relative to the apparatus body.

As depicted in FIG. 10, the adjuster 43 includes the reference portion 43A and an adjusting portion 43B. The reference portion 43A is provided at an end portion (e.g., a left end portion) of the second guide 27 in the width direction. The reference portion 43A has a pivot point O1 about which the second guide 27 pivots.

The second guide 27 is configured to pivot about the pivot point O1 in a pivot plane. The pivot plane is an imaginary plane (e.g., horizontal plane) extending in a direction orthogonal to an arranging direction of the first guide 25 and the second guide 27 (e.g., a vertical direction).

In the illustrative embodiment, the reference portion 43A and the coupling portion 41 are located at a first end portion (e.g., the left end portion) of the return unit 23 in the width direction.

The adjusting portion 43B is located at an end (e.g., the right end portion) of the second guide 27 opposite to the reference portion 43A. The reference portion 43A and the adjusting portion 43B are located at opposite sides of the sheet passing zone W2 (FIG. 7). The adjusting portion 43B may be operated to pivotally move the second guide 27 about the reference portion 43A (e.g., the pivot point O1).

The adjusting portion 43B includes a pressing portion 43C and a pressed portion 43D. The pressing portion 43C is configured to apply pressure to the pressed portion 43D. The pressing portion 43C includes a threaded member, e.g., a bolt, that engages in a screw hole 43E formed in the apparatus body. An end of the pressing portion 43C engaged in the screw hole 43E may contact the pressed portion 43D.

The pressed portion 43D is located at the second guide 27 and configured to receive the pressure applied by the pressing portion 43C.

The adjuster 43 further includes a spring 43F that applies an elastic force against the pressure of the pressing portion 43C to the second guide 27.

Tightening the pressing portion 43C (e.g., the bolt) deforms the spring 43F elastically, thereby causing the second guide 27 to pivot leftward (counterclockwise) about the pivot point O1 in FIG. 10.

Loosening the pressing portion 43C (e.g., the bolt) returns the spring 43F its original position, thereby causing the second guide 27 to pivot rightward (clockwise) about the pivot point O1 in FIG. 10.

The adjuster 43 further includes tabs 43G, 43H, 43J, and 43K that are provided at the second guide 27. Each of the tabs 43G, 43H, 43J, and 43K has an elongated hole shaped like an arc on a circle centered on the pivot point O1. A positioning pin (not depicted) is fixed via the elongated hole relative to the apparatus body. The positioning pin may slidably contact walls defining the elongated hole when the second guide 27 is pivotally moved by a user operating the pressing portion 43C. This configuration may limit pivotal movement of the second guide 27 along the pivot plane.

4. Features of Image Forming Apparatus

The image forming apparatus 1 may allow a user to adjust the orientation (e.g., skew) of the return unit 23 relative to the apparatus body, instead of eliminating a fixed guide for the single edge alignment. This adjustment may reduce a possibility of improper orientation of a sheet due to a dimensional deviation in manufacturing the image forming apparatus 1 that does not employ the single edge alignment. Accordingly, a sheet may be returned in a proper orientation toward the image forming unit 5.

The return unit 23 includes the first guide 25 and the second guide 27. By slidably moving the first guide 25 relative to the second guide 27, a jammed smaller-sized sheet, which may stay at a location with restricted access (e.g., a rear portion of the return unit 23), may be readily removed.

The angular axial orientation of the second roller 35 relative to the apparatus body may be adjusted with the second roller 35 positioned relative to the first roller 29 by, for example, the first positioned portions 25A and the first positioning portions 27A. A user may adjust the adjuster 43 to obtain a favorable duplex-printing output by the image forming apparatus 1 that does not employ the single edge alignment for sheets.

The image forming apparatus 1 may achieve favorable duplex printing on smaller-sized sheets and allow a user to readily clear a smaller-sized sheet jammed in the return unit 23, if any.

In the illustrative embodiment, the second guide 27 includes the slide guides 27B that guide the sliding movement of the first guide 25 relative to the second guide 27. This configuration may allow a user to mount and dismount the first guide 25 relative to the second guide 27 while the movement of the first guide 25 is guided by the slide guides 27B.

In the illustrative embodiment, the first guide 25 is disposed above the second guide 27, such that the first guide 25 is detachably attachable from the second guide 27. The feed tray 21 is detachably attached to a portion of the apparatus body above the first guide 25. This configuration may allow a user to readily remove or dismount the first guide 25 from the second guide 27 after removing the feed tray 21 from the apparatus body. The first guide 25 removed from the second guide 27 may also be removed from the apparatus body.

In the illustrative embodiment, at least one of the first roller 29 and the second roller 35 may be rotated by drive force received from the apparatus body, via the coupling portion 41. The coupling portion 41 and the reference portion 43A, which is generally immovable or fixed relative to the apparatus body, are located at a first end portion (e.g., left end portion) of the return unit 23. This configuration may allow the coupling portion 41 to transmit the drive force reliably and efficiently.

If the coupling portion 41 is unstably positioned relative to the apparatus body, the coupling portion 41 may fail to reliably and efficiently transmit the drive force from the apparatus body to the return unit 23.

In the illustrative embodiment, the imaginary plane S1, which extends through axes of the first roller 29 and the second roller 35, passes through a contact portion between the rear-side first positioned portion 25A and the rear-side first positioning portion 27A. This configuration may help increase contact pressure between the rear-side positioned portion 25A and the rear-side positioning portion 27A effectively.

Figure 9B:
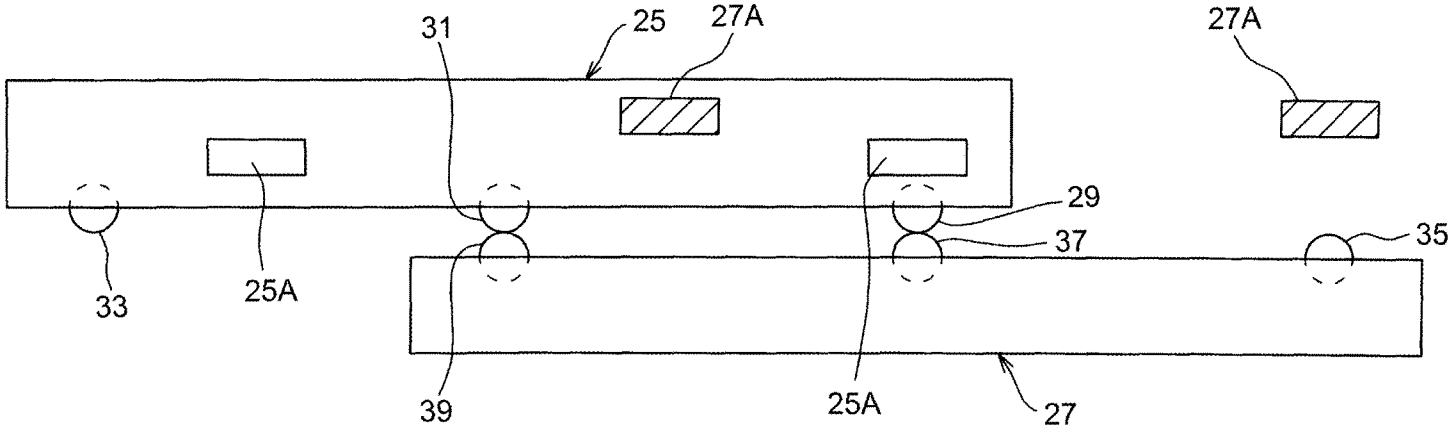

In the illustrative embodiment, the imaginary plane S2, which extends through axes of the third roller 31 and the fourth roller 37, does not pass through a contact portion between the front-side first positioned portion 25A and the front-side first positioning portion 27A, but passes through a location away from the contact portion in the sheet conveying direction. During removal (e.g., sliding movement relative to the second guide 27) as depicted in FIG. 9B, the first guide 25 may tend to move upward away from the second guide 27, so that a user may readily remove the first guide 25 from the second guide 27.

Other Illustrative Embodiments

In the above-described illustrative embodiment, the first guide 25 includes the first positioned portions 25A located at both end portions (e.g., left and right end portions) thereof in the width direction. Similarly, the second guide 27 includes the first positioning portions 27A located at both end portions thereof in the width direction. In another embodiment, one first positioned portion 25A, one first positioning portion 27A and the reference portion 43A may be located at a first end portion of the return unit 23 in the width direction, without another first positioned portion 25A and another first positioning portion 27A on a second end portion of the return unit 23.

In the above-described illustrative embodiment, the third positioned portion 25D, the third positioning portion 27D, and the reference portion 43A are located at the first end portion of the return unit 23 in the width direction. In another embodiment, the third positioned portion 25D and the third positioning portion 27D may be located at a second end portion of the return unit 23, which is opposite to the first end portion of the return unit 23 where the reference portion 43A is located. Alternatively, the third positioned portion 25D and the third positioning portion 27D may be located at each end portion of the return unit 23 in the width direction.

In the above-described illustrative embodiment, the coupling portion 41 and the reference portion 43A are located at the first end portion of the return unit 23 in the width direction. In another embodiment, for example, the coupling portion 41 may be located at a first end portion of the return unit 23 in the width direction and the reference portion 43A may be located at a second end portion of the return unit 23 in the width direction, or vice versa.

In the illustrative embodiment, the imaginary plane S1 passes through the contact portions between the rear-side first positioned portions 25A and the rear-side first positioning portions 27A. The imaginary plane S2 is spaced in the sheet conveying direction from the contact portions between the front-side first positioned portions 25A and the front-side first positioning portions 27A. In another embodiment, the arrangements of the first positioned portions 25A, the first positioning portions 27A, and rollers of the first guide 25 and the second guide 27, are not limited to what has been particularly illustrated and described hereinabove.

In the above-described illustrative embodiment, the third positioned portion 25D protrudes upward and the third positioning portion 27D is recessed with an open end thereof facing downward. In another embodiment, the third positioned portion 25D may protrude downward and the third positioning portion 27D may be recessed with an open end thereof facing upward.

What is claimed is:

1. An image forming apparatus configured to form images on a first surface and a second surface of a sheet, comprising:
- an apparatus body;
- an image forming unit configured to form the images on the sheet;
- a feed tray detachably attached to the apparatus body; and
- a return unit configured to return the sheet having an image formed on the first surface of the sheet toward the image forming unit; the return unit including:
  - a first guide configured to be inserted into and removed from the apparatus body, the first guide including:
    - a first roller configured to rotate in contact with the sheet; and
    - a positioned portion;
  - a second guide positioned in the apparatus body, the first guide being detachably attached to the second guide, the second guide including:
    - a second roller configured to rotate in contact with the sheet at a position facing the first roller; and
    - a positioning portion configured to contact the positioned portion of the first guide, thereby positioning the first guide relative to the second guide; and
  - an adjuster configured to adjust an orientation of the second guide relative to the apparatus body.

2. The image forming apparatus according to claim 1, wherein the adjuster is configured to adjust an angular axial orientation of the second roller of the second guide relative to the apparatus body.

3. The image forming apparatus according to claim 1, wherein the second guide further includes a slide guide configured to guide sliding movement of the first guide relative to the second guide.

4. The image forming apparatus according to claim 1, wherein the first guide is disposed above the second guide such that the first guide is detachable from the second guide, and
- the feed tray is detachably attached to a portion of the apparatus body above the first guide.

5. The image forming apparatus according to claim 1, wherein the adjuster includes:
- a reference portion located at a first end portion of the second guide in a width direction parallel to an axis of the second roller, the reference portion being configured to allow the second guide to pivot thereabout along an imaginary pivot plane orthogonal to a direction in which the first guide and the second guide are arranged, and
- an adjusting portion located on a second end portion of the second guide in the width direction opposite to the first end portion, the adjusting portion being configured to pivotally move the second guide about the reference portion.

6. The image forming apparatus according to claim 5, wherein the adjusting portion includes:
- a pressing portion; and
- a pressed portion located at the second guide and configured to receive pressure applied by the pressing portion.

7. The image forming apparatus according to claim 5, wherein the positioning portion, the positioned portion, and the reference portion are located in a first end portion of the return unit in the width direction corresponding to the first end portion of the second guide.

8. The image forming apparatus according to claim 5, further comprising a coupling portion configured to transmit drive force received from the apparatus body, to at least one of the first roller and the second roller such that the at least one of the first roller and the second roller rotates, the coupling portion being located at a first end portion of the return unit in the width direction corresponding to the first end portion of the second guide.

9. The image forming apparatus according to claim 1, wherein a first imaginary plane including an axis of the first roller and an axis of the second roller, passes through a contact portion between the positioning portion and the positioned portion.

10. The image forming apparatus according to claim 1, wherein the first guide further includes:
- a third roller configured to rotate in contact with the sheet, the third roller being spaced from the first roller in a sheet conveying direction; and
- a further positioned portion spaced from the positioned portion in the sheet conveying direction, wherein the second guide further includes:
- a fourth roller configured to rotate in contact with the sheet at a position facing the third roller; and
- a further positioning portion spaced from the positioning portion in the sheet conveying direction and configured to contact the further positioned portion of the first guide, thereby positioning the first guide relative to the second guide, and wherein a second imaginary plane including an axis of the third roller and an axis of the fourth roller is spaced in the sheet conveying direction from a further contact portion between the further positioning portion and the further positioned portion.

* * * * *